US006532027B2

(12) United States Patent
Ozaki et al.

(10) Patent No.: US 6,532,027 B2
(45) **Date of Patent: *Mar. 11, 2003**

(54) INK JET RECORDING HEAD, SUBSTRATE FOR THIS HEAD, MANUFACTURING METHOD OF THIS SUBSTRATE AND INK JET RECORDING APPARATUS

(75) Inventors: Teruo Ozaki, Yokohama (JP); Masahiko Ogawa, Hino (JP); Tomoyuki Hiroki, Zama (JP); Muga Mochizuki, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,800

(22) Filed: Dec. 15, 1998

(65) Prior Publication Data

US 2002/0135641 A1 Sep. 26, 2002

(30) Foreign Application Priority Data

Dec. 18, 1997 (JP) ..... 9-349335

(51) Int. Cl.[7] ..... B41J 2/05
(52) U.S. Cl. ..... 347/64; 216/27
(58) Field of Search ..... 347/63, 64; 29/890.1; 216/27

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,429,321 A | | 1/1984 | Matsumoto | 347/59 |
| 4,450,457 A | * | 5/1984 | Miyachi et al. | 347/64 |
| 4,459,600 A | | 7/1984 | Sato et al. | 347/47 |
| 4,463,359 A | | 7/1984 | Ayata et al. | 347/56 |

(List continued on next page.)

FOREIGN PATENT DOCUMENTS

| | | | |
|---|---|---|---|
| EP | 0 434 946 A2 | | 7/1991 |
| EP | 0 521 634 A2 | | 1/1993 |
| EP | 0 698 494 A2 | | 2/1996 |
| JP | 53072473 | * | 6/1978 |

(List continued on next page.)

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

An ink jet recording head in which a heating resistor forming a heating portion, a wiring electrically connected to the heating resistor, and a protective film formed on the heating resistor and the wiring to protect the heating resistor and the wiring are arranged on a substrate for the ink jet recording head. An ink path in communication with a discharging port for discharging ink is also formed on the substrate for the ink jet recording head. The protective film includes a first protective film layer for covering the heating resistor and the wiring, a second protective film layer formed on the first protective film layer by a material different from that of the first protective film layer and having an opening in a portion corresponding to the heating portion of the heating resistor, and a third protective film layer constructed of the same material system as the first protective film layer and covering the second protective film layer and the portion of the first protective film layer that is exposed through the opening. The second protective film layer is constructed of an inorganic material.

38 Claims, 5 Drawing Sheets

U.S. PATENT DOCUMENTS

| | | | | | |
|---|---|---|---|---|---|
| 4,558,333 | A | | 12/1985 | Sugitani et al. | 347/65 |
| 4,596,994 | A | | 6/1986 | Matsuda et al. | 347/64 |
| 4,608,577 | A | | 8/1986 | Hori | 347/66 |
| 4,686,544 | A | * | 8/1987 | Ikeda et al. | 347/64 |
| 4,719,477 | A | | 1/1988 | Hess | 347/59 |
| 4,723,129 | A | | 2/1988 | Endo et al. | 347/56 |
| 4,740,796 | A | | 4/1988 | Endo et al. | 347/56 |
| 5,455,612 | A | | 10/1995 | Ikeda et al. | 347/64 |
| 5,660,739 | A | | 8/1997 | Ozaki et al. | 216/27 |

FOREIGN PATENT DOCUMENTS

| | | | |
|---|---|---|---|
| JP | 54-56847 | | 5/1979 |
| JP | 59-123670 | | 7/1984 |
| JP | 59-138461 | | 8/1984 |
| JP | 60-71260 | | 4/1985 |
| JP | 3106663 | * | 5/1991 |
| JP | 8097171 | * | 4/1996 |
| JP | 8-112902 | | 5/1996 |

* cited by examiner

INK JET RECORDING HEAD, SUBSTRATE FOR THIS HEAD, MANUFACTURING METHOD OF THIS SUBSTRATE AND INK JET RECORDING APPARATUS

BACKGROUND OF THE INVENTION

1. Field of the Invention

The present invention relates to an ink jet recording head for performing a recording operation by discharging ink, a substrate for such a head, a method of manufacturing such a substrate, and an ink jet recording apparatus.

2. Related Background Art

In an ink jet recording system of the type disclosed in U.S. Pat. Nos. 4,723,129 and 4,740,796, for example, a recording operation can be performed at a high speed with high density, high accuracy, and high image quality. Such a system also provides suitable coloring and compactness. An ink jet recording system typically operates by discharging ink onto a recording medium by utilizing thermal energy to bubble the ink. A recording head for such a system generally is constructed by providing a heating resistor, for generating a bubble in the ink, and wiring, for providing an electrical connection to the heating resistor, on a substrate. A nozzle for discharging the ink generally is also formed on this substrate. resistor. Typically, the protective film has a thickness of about 1 $\mu$m.

Japanese Laid-Open Patent Application No. 08-112902 describes a method for partially reducing the thickness of the protective film on the heating resistor while stabilizing its protective function with respect to the wiring. With this method, the amount of energy applied can be reduced and the life of the recording head can be stabilized by reducing the thickness of the protective film only on the heating resistor.

In the above example, a heating resistor and a wiring pattern are first formed on a silicon oxide film on a substrate. Next, silicon oxide is formed as a first protective film layer. Next, the first protective film layer is partially removed from a heating portion of the heating resistor by patterning. Finally, silicon nitride is formed as a second protective film layer. This arrangement, however, has the following problems.

The first protective film layer normally is partially removed from the heating portion by wet etching. If the first protective film layer is formed of silicon oxide, a hydrogen fluoride-based etching liquid is used. The heating resistor, which is generally constructed of $HfB_2$ and TaN, is not damaged by the hydrogen fluoride-based etching liquid.

Here, there is no problem in a manufacturing process when the removed portion of the protective film is inside the heating portion of the heating resistor The substrate for the ink jet recording head includes various means for saving applied electric energy, on the one hand, and for preventing a reduction in the life of the substrate resulting from mechanical damage caused by the bubbling of the ink and the destruction of a heating portion caused by a thermal pulse, on the other hand. In particular, the substrate has a protective film for protecting the heating resistor, and, specifically, a heating portion located between a pair of wiring patterns, from the ink.

To maximize thermal efficiency, it is advantageous that this protective film have a high thermal conductivity or be relatively thin. However, to minimize mechanical damage and the probability of a defect in the protective film caused by the bubbling of the ink, it is advantageous that the protective film be relatively thick. Further, the protective film also protects the wiring connected to the heating resistor from the ink, which requires that the protective film have a certain thickness.

The surface of the heating resistor is generally very smooth and the protective film can be closely formed on this surface. In contrast, the wiring is generally formed from aluminum (Al), the surface of which tends to be influenced by heat during the manufacturing process, and, therefore, often has irregularities. Further, the aluminum is about 500 nm thick, so that the quality of the protective film is degraded where the wiring steps down to the heating by about several $\mu$m. However, thermal efficiency is reduced since the removed portion is a relatively small area within the heating portion as compared to the total area of the heating portion.

In contrast, when the first protective film layer is formed with a step difference between the wiring and the heating resistor and the substrate below the heating resistor, the quality of the first protective film layer oftentimes is poor in this step difference portion. Therefore, when the first protective film layer is widely removed over the heating portion of the heating resistor, a portion of the protective film near the step difference between the heating resistor and the substrate below the heating resistor is etched. Accordingly, undercut is advanced along the step difference portion, which has a relatively poor film quality, so that an air hole is caused in the film interior. As a result, the life of the recording head substrate is reduced. The quality of the first protective film layer in the step difference portion is further degraded since a vertical etching technique is often employed to provide a fine structure and since a cross section of the heating resistor rises steeply at approximately 90°. Accordingly, it has been necessary to strictly control the etching time of the first protective film layer to reduce the undercut as much as possible.

SUMMARY OF THE INVENTION

An object of the present invention is to provide an ink jet recording head, a substrate for such a head, a method of manufacturing such a substrate, and an ink jet recording apparatus for solving the above problems by utilizing as much of a heating portion of a heating resistor as possible through an easily controlled process. Thus, the present invention lengthens the life of the recording head while saving energy by improving thermal efficiency.

Another object of the present invention is to provide an ink jet recording head, in which a heating resistor forming a heating portion, wiring electrically connected to the heating resistor, and a protective film formed on the heating resistor and the wiring to protect the heating resistor and the wiring are arranged on a substrate for the ink jet recording head. An ink path, in communication with a discharging port for discharging ink, also is formed on the substrate for the ink jet recording head. The protective film includes a first protective film layer for covering the heating resistor and the wiring, a second protective film layer formed on the first protective film layer of a material different from that of the first protective film layer and having an opening in a portion corresponding to the heating portion of the heating resistor, and a third protective film layer constructed of the same material system as the first protective film layer and covering the second protective film layer and the portion of the first protective film layer that is exposed through the opening. The second protective film layer is constructed of an inorganic material.

Another object of the present invention is to provide a substrate for an ink jet recording head, in which a heating resistor forming a heating portion, wiring electrically connected to the heating resistor, and a protective film formed on the heating resistor and the wiring to protect the heating resistor and the wiring are arranged on the substrate. The protective film includes a first protective film layer for covering the heating resistor and the wiring, a second protective film layer formed on the first protective film layer of a material different from that of the first protective film layer and having an opening in a portion corresponding to the heating portion of the heating resistor, and a third protective film layer constructed of the same material system as the first protective film layer and covering the second protective film layer and the portion of the first protective film layer that is exposed through the opening. The second protective film layer is constructed of an inorganic material.

Still another object of the present invention is to provide a method of manufacturing a substrate for an ink jet recording head, in which a heating resistor forming a heating portion, wiring electrically connected to the heating resistor, and a protective film formed on the heating resistor and the wiring to protect the heating resistor and the wiring are arranged on the substrate. The method comprises the steps of forming a first protective film layer so as to cover the heating resistor and the wiring, forming a film of an inorganic material that is different from the material of the first protective film layer on the first protective film layer, etching the film of inorganic material in a portion corresponding to the heating portion of the heating resistor and removing the inorganic material film from this corresponding portion to form a second protective film layer having an opening in the corresponding portion, and forming a third protective film layer of the same material system as the first protective film layer so as to cover the second protective film layer and the portion of the first protective film layer that is exposed through the opening.

In the present invention, since the heating resistor and the wiring are covered with the first protective film layer, the step difference is lessened in corner portions of the heating resistor and the wiring pattern. Accordingly, the quality of the second protective film layer formed on the first protective film layer is improved and overetching is substantially avoided along the step difference portion when the second protective film layer is etched.

The third protective film layer, which is constructed of the same material system as the first protective film layer, serves as a protective film for the heating portion, together with the first protective film layer left on the heating portion. Further, the third protective film layer is laminated with the first and second protective film layers thereon so that a protective film having at least three layers is formed on the wiring. Thus, the films are formed by dividing these films into plural layers. Accordingly, when there is a defect in any one portion of a protective film of one layer, it is possible to reduce the probability of an occurrence of a defect caused in a portion of the entire protective film of a plural-layer structure.

Thus, in accordance with the present invention, it is possible to provide an ink jet recording head, a substrate for such a head, a method of manufacturing such a substrate, and an ink jet recording apparatus, with energy savings, stable lifetimes, and convenient process control.

DESCRIPTION OF THE PREFERRED EMBODIMENTS

Figure 1:
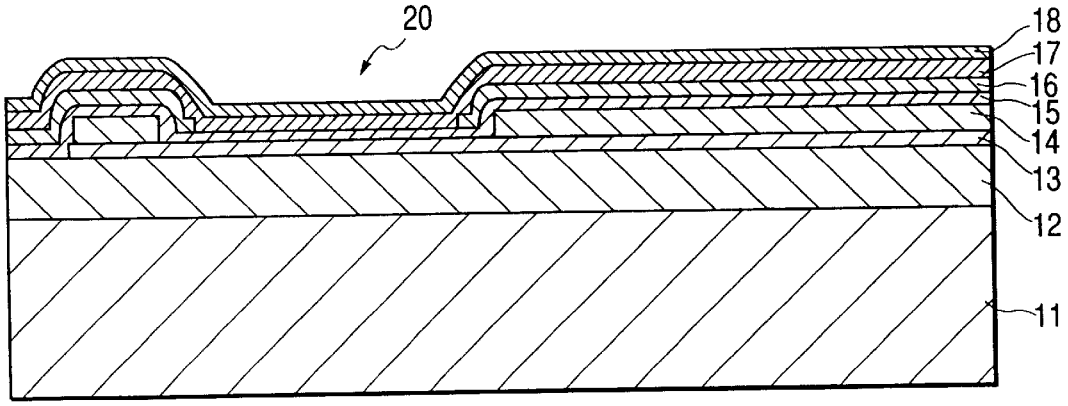
FIG. 1 is a side sectional view showing one example of a substrate for an ink jet recording head of the present invention.

An ink jet recording head according to the present invention has a structure in which a heating resistor forming a heating portion, wiring electrically connected to the heating resistor, and a protective film formed on the heating resistor and the wiring to protect the heating resistor and the wiring are arranged on a substrate for the ink jet recording head. An ink path in communication with a discharging port for discharging ink also is formed on the substrate for the ink jet recording head. The protective film includes a first protective film layer for covering the heating resistor and the wiring, a second protective film layer formed on the first protective film layer of a material different from that of the first protective film layer and having an opening in a portion corresponding to the heating portion of the heating resistor, and a third protective film layer constructed of the same material system as the first protective film layer and covering the second protective film layer and the portion of the first protective film layer exposed through the opening. The second protective film layer is constructed of an inorganic material.

In the present invention, the second protective film layer is mainly formed of a material different from that of the first protective film layer for manufacturing reasons. The opening in the second protective film layer normally is formed by etching. Accordingly, it is preferable that the second protective film layer be formed of a material that is easily etched in comparison with the first protective film layer. Namely, it is preferable to select this material such that an etching speed of the second protective film layer material is higher than that of the first protective film layer material. It is particularly preferable that a selecting ratio (i.e., the etching speed of the second protective film layer material/the etching speed of the first protective film layer material) be equal to 10 or more. It is further preferable that this selecting ratio be equal to 20 or more.

In the present invention, the first and third protective film layers are formed of the same material system mainly in view of the close attaching strengths of these films in the opening of the heating portion. Here, as mentioned above, the second protective film layer is formed of a material different from the materials of the first and third protective film layers, but is preferably formed by the same material system as the first and third protective film layers. It is particularly preferable that "the same material system" be a material including silicon. For example, it is suitable that the first and third protective film layers be formed of silicon nitride and that the second protective film layer be formed of silicon oxide.

It is preferable to form the second protective film layer of silicon oxide including boron or phosphorus since this increases the etching rate difference between the second protective film layer and the silicon nitride film.

In the present invention, the first protective film layer normally has a thickness from 0.01 to 0.5 μm, and preferably a thickness from 0.01 to 0.1 μm. The second protective film layer normally has a thickness from 0.3 to 1.5 μm, and preferably a thickness from 0.5 to 1.0 μm. The third protective film layer normally has a thickness from 0.1 to 1.0 μm, and preferably a thickness from 0.1 to 0.5 μm.

The present invention will be explained in further detail with reference to several preferred embodiments described below.

Embodiment 1

Figure 2:
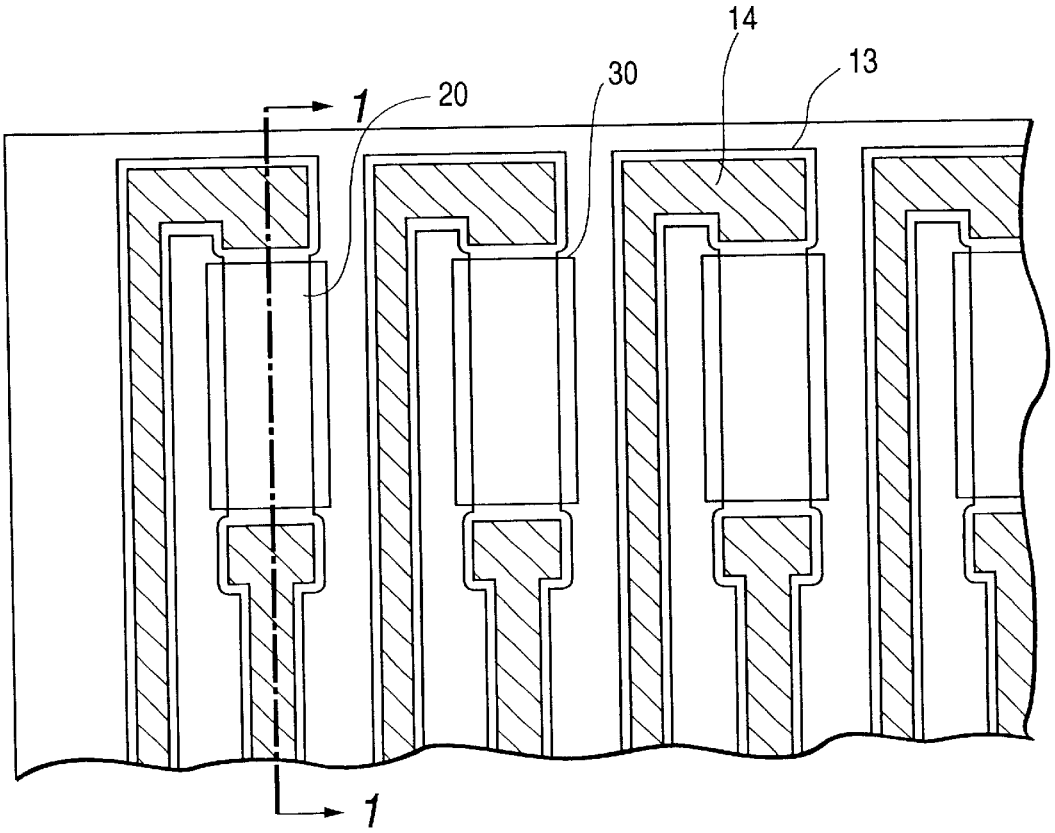
FIG. 2 is a plan view showing one example of the substrate for the ink jet recording head of the present invention.

FIG. 2 is a plan view showing a main portion of a substrate for an ink jet recording head of the present invention. FIG. 1 is a side sectional view taken along sectional line 1—1 in FIG. 2.

As shown in FIGS. 1 and 2, a silicon oxide film, which serves as a heat accumulating layer 12, is formed on a silicon substrate 11. Aluminum layers, which serve as a heating resistor layer 13 and a wiring layer 14, are respectively formed in predetermined pattern shapes on the silicon oxide film. The heating resistor layer 13 forms a heating portion 20 in a gap within wiring layer 14.

A silicon nitride layer, which serves as a first protective film layer 15, a silicon oxide layer, which serves as a second protective film layer 16, a silicon nitride film, which serves as a third protective film layer 17, and a tantalum (Ta) film, which serves as a cavitation resisting film 18, are sequentially formed such that the heating resistor layer 13 and the wiring layer 14 are covered by the films 15, 16, 17, and 18. The second protective film layer 16 has an opening adjacent to the heating portion 20 of the heating resistor layer 13. Further, the cavitation resisting film 18 is arranged mainly to protect the substrate from impact at bubbling and debubbling times and cavitation destruction.

A method of manufacturing the substrate for the ink jet recording head having the above-described structure next will be explained with reference to FIGS. 3A to 3D and FIGS. 4E to 4G.

Figure 3A:
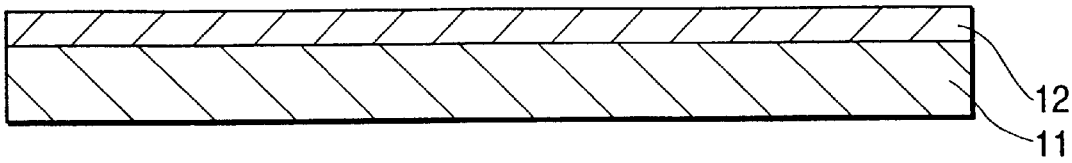
FIGS. 3A, 3B, 3C, and 3D are side sectional views showing various stages of a process of manufacturing the substrate for the ink jet recording head of the present invention.

As shown in FIG. 3A, a silicon oxide film constituting a heat accumulating layer 12 is formed on a silicon substrate 11 by a thermal oxidation method, a sputtering method, a CVD method, or the like.

Figure 3B:
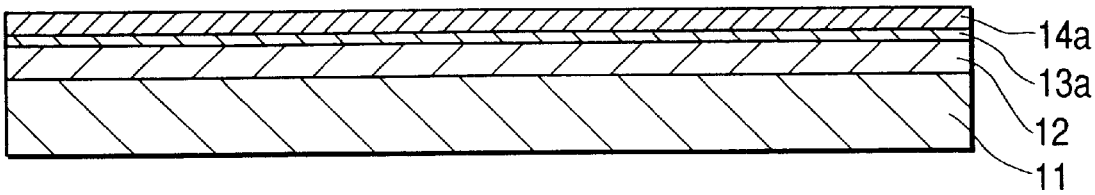

Next, as shown in FIG. 3B, a TaN layer 13*a*, which serves as a heating resistor layer 13, is formed on the heat accumulating layer 12 by reactive sputtering such that the TaN layer 13*a* is about 100 nm thick. Further, an aluminum layer 14*a*, which serves as a wiring layer 14, is formed on the TaN layer 13*a* by sputtering such that the aluminum layer 14*a* is 500 nm thick.

Figure 3C:
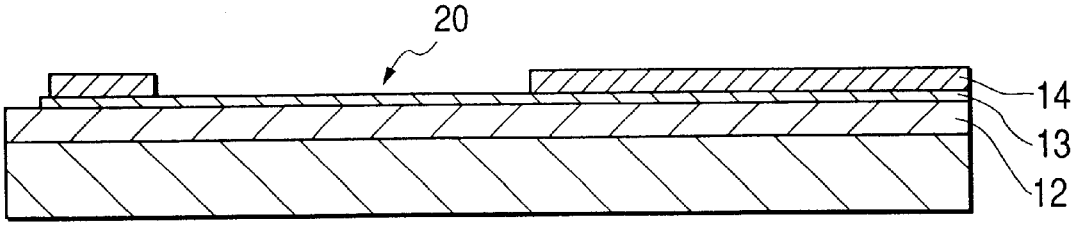

Next, the aluminum layer 14*a* is wet-etched using a photolithography method and the TaN layer 13*a* is reactively etched so that the wiring layer 14 and the heating resistor layer 13 each have a sectional shape as shown in FIG. 3C (see FIG. 1 with respect to their planar shape). In the heating portion 20, the aluminum layer 14*a* is removed, thereby exposing the heating resistor layer 13. Accordingly, heat is generated in the heating portion 20 when an electric current flows through the wiring layer 14.

Figure 3D:
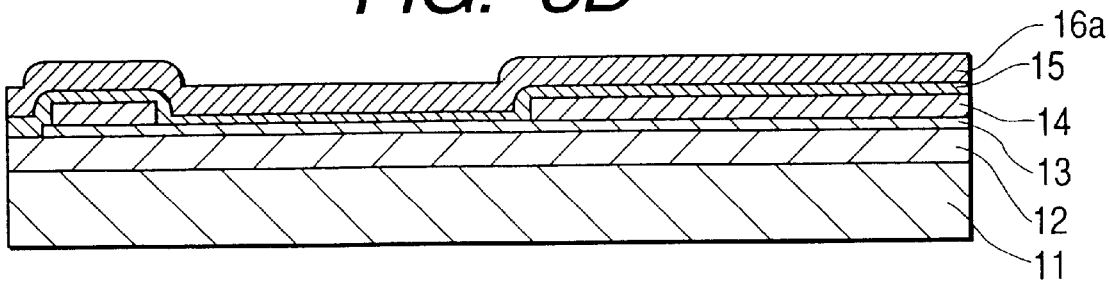

Next, as shown in FIG. 3D, a silicon nitride film, which serves as a first protective film layer 15, is formed by a CVD method such that the silicon nitride film is 200 μm thick. A silicon oxide film 16*a*, which serves as a second protective film layer 16, is formed by a CVD method such that the silicon oxide film 16*a* is 500 nm thick.

Figure 4E:
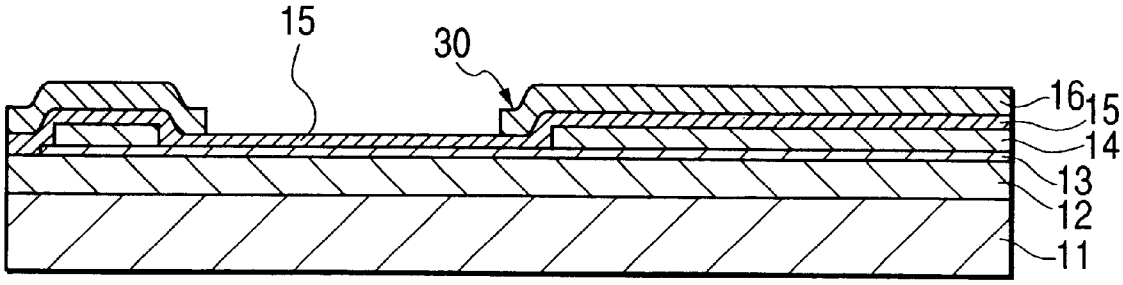
FIGS. 4E, 4F, and 4G are side sectional views, similar to FIGS. 3A, 3B, 3C, and 3D, showing various stages of a process of manufacturing the substrate for the ink jet recording head of the present invention.

Next, the silicon oxide film 16*a* in the heating portion 20 of the heating resistor is partially etched using a photolithography method and a hydrogen fluoride liquid so that the second protective film layer 16 is formed as shown in FIG. 4E. At this time, a step difference 30 is created.

Figure 4F:
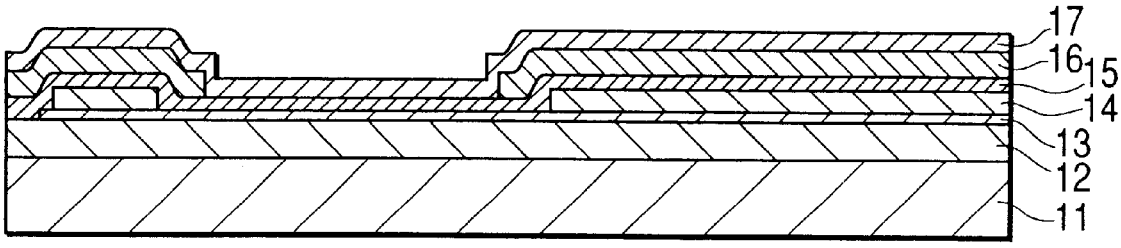

Next, as shown in FIG. 4F, more silicon nitride, which now serves as a third protective film layer 17, is formed by a CVD method such that this silicon nitride layer is 300 nm thick.

Figure 4G:
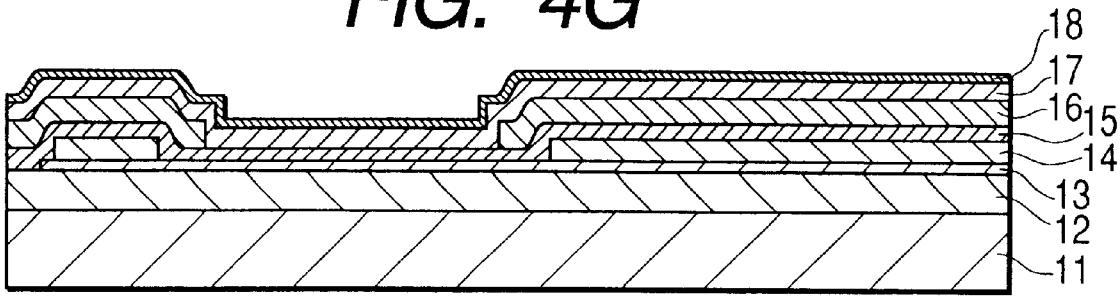

Next, as shown in FIG. 4G, tantalum (Ta), which serves as a cavitation resisting film 18, is formed by a sputtering method such that the tantalum film is 200 nm thick.

Finally, the tantalum (Ta) film and the first, second, and third protective film layers are etched by a photolithography method so that an aluminum electrode pad required for a connection with an external power source is exposed. Thus, the manufacture of the main portion of the substrate for the ink jet recording head is completed.

The ink jet recording head then is assembled using the substrate manufactured in the way described above. When performance of this ink jet recording head is checked, it is confirmed that power can be saved and that the life of the ink jet recording head can be extended.

Embodiment 2

Similar to Embodiment 1, an ink jet recording head is manufactured, except that here silicon oxide doping boron or phosphorus thereinto is used as the second protective film layer. As a result, the etching rate with respect to a hydrogen fluoride liquid is increased, and a selecting ratio with respect to silicon nitride as the material of the first protective film layer is further increased. Thus, damage to the first protective film layer caused during etching of the second protective film layer is reduced so that the thickness of the second protective film layer can be further increased. Accordingly, the wiring layer can be further reliably protected while power is saved.

In the above embodiments, as shown in U.S. Pat. No. 4,429,321, an integrated circuit for operating the heating resistor may be made within the same silicon substrate. In this case, similar to a wiring portion, it is preferable to cover a portion of the integrated circuit with the first, second, and third protective film layers.

Other Embodiments

Figure 5:
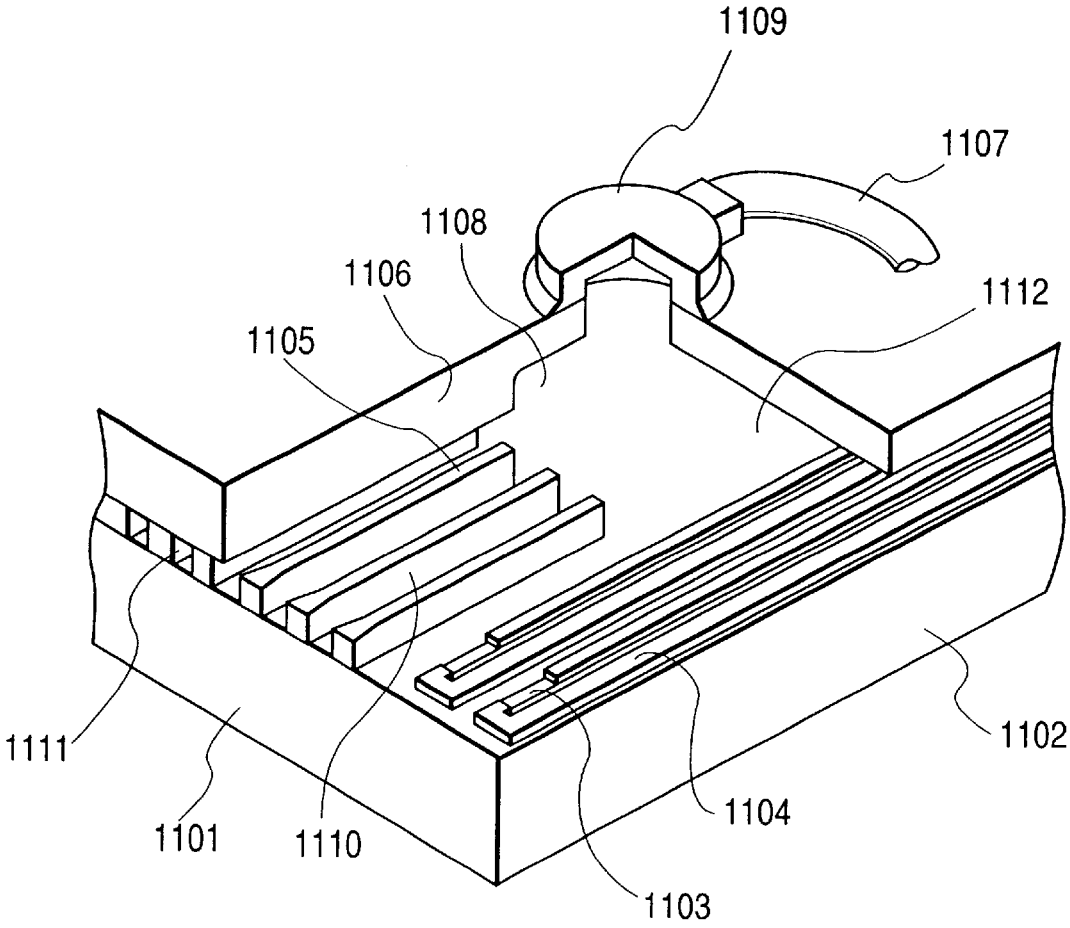
FIG. 5 is a partial cut-away perspective view showing a main portion of the ink jet recording head of the present invention.

An ink jet recording head and an ink jet recording device embodying the substrate of the present invention will next be explained. FIG. 5 is a partial cut-away perspective view showing such an ink jet recording head. The ink jet recording head includes an electrothermal converting element 1103, wiring 1104, a liquid path wall 1105, and a roof plate 1106, which are formed as films on a substrate 1102 through semiconductor processes such as etching, evaporation, sputtering, and the like.

A liquid 1112 for recording is supplied from liquid storing chamber (not shown) into a common liquid chamber 1108 of the head 1101 through a liquid supply tube 1107. In FIG. 5, reference numeral 1109 designates a connector for the liquid supply tube 107. The liquid 1112 supplied into the common liquid chamber 1108 is drawn into a liquid path 1110 by a so-called "capillary" phenomenon, and is held stably by forming a meniscus on a discharging port face (an orifice face) of this liquid at an end tip of the liquid path.

Here, the liquid on a face of the electrothermal converting element is rapidly heated by supplying an electric current through the electrothermal converting element 1103 so that an air bubble is caused within the liquid path. The liquid is discharged from the discharging port 1111 by expansion and contraction of this air bubble so that a liquid drop is formed.

Figure 6:
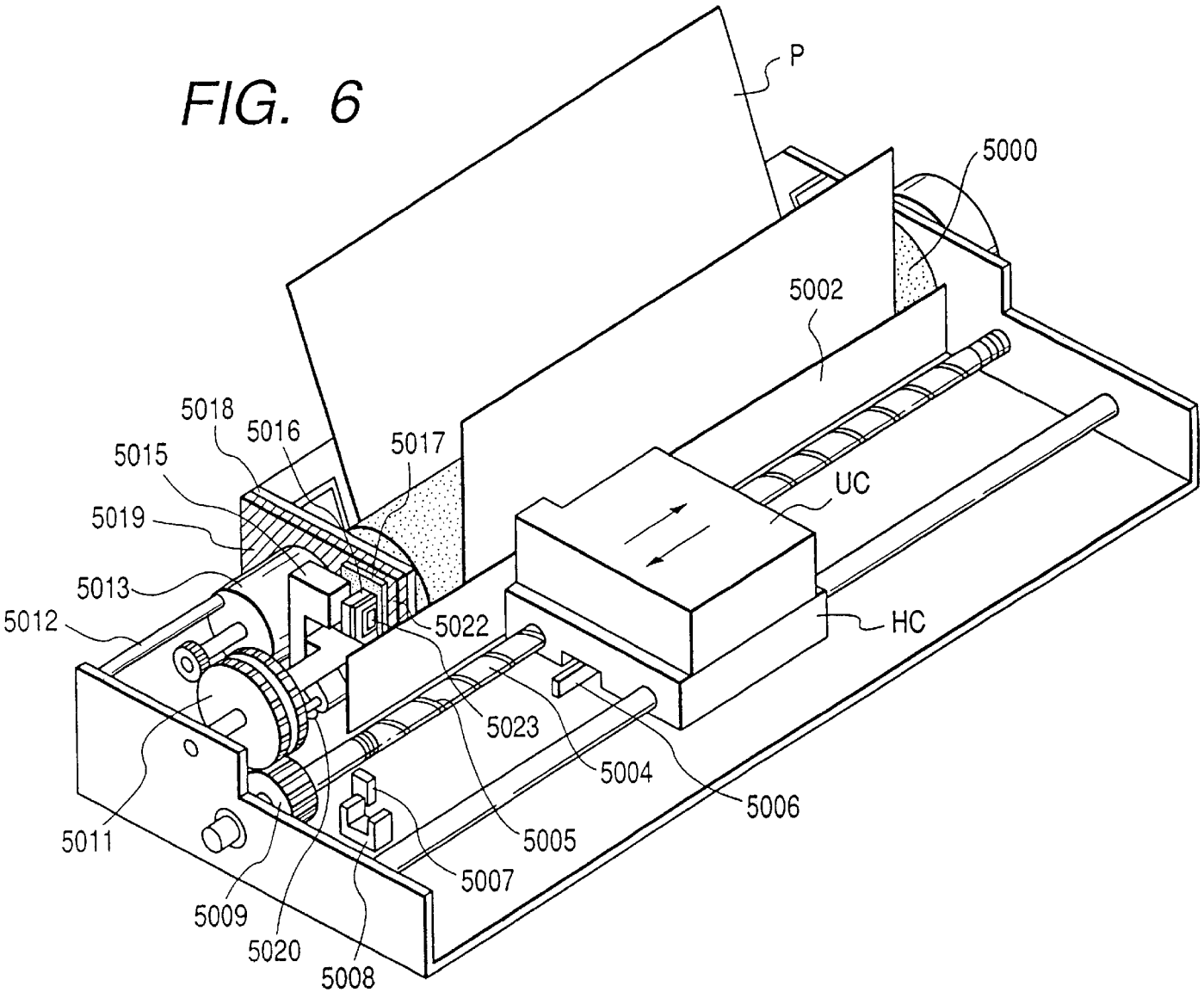
FIG. 6 is a perspective view showing a main portion of an ink jet recording apparatus of the present invention.

FIG. 6 is a perspective view showing a main portion of an ink jet device to which the present invention can be applied. A carriage HC engages a spiral groove 5005 of a lead screw 5004, which is rotated through driving force transmission gears 5011, 5009 in association with normal and reverse rotations of a drive motor 5013. The carriage HC has an unillustrated pin and is reciprocated in the directions indicated by arrows in FIG. 6. Reference numeral 5002 designates a paper pressing plate for pressing paper (p) against a platen 5000 in a moving direction of the carriage. Photocouplers 5007, 5008 are home position detecting means for confirming the existence of a lever 5006 of the carriage in this area and switching the rotating directions of the motor 5013, etc.

Reference numeral 5016 designates a member for supporting a cap member 5022 for capping a front face of the recording head (UC). Reference numeral 5015 designates a suction means for suctioning the interior of this cap and the suctioning means 5015 performs a suctioning recovery operation for the recording head through an opening 5023 within the cap. Reference numeral 5017 designates a cleaning blade and reference numeral 5019 designates a member capable of moving this blade in forward and backward directions. The cleaning blade 5017 and this member 5019 are supported by a main body supporting plate 5018. A well-known cleaning blade having a shape other than that illustrated in FIG. 6 can be also applied to this example. Reference numeral 5012 designates a lever for starting suction of the suctioning recovery. This lever 5012 is moved as a cam 5020 engaged with the carriage is moved. Driving force from the drive motor is controlled in this movement by a well-known transmission means such as a clutch switch, etc.

These capping, cleaning, and suctioning recovery portions are constructed such that desirable processing is performed in their corresponding positions by an operation of the lead screw 5004 when the carriage reaches a home position side area. However, each of these constructions can be applied to the present invention if a desirable operation is performed in well-known timing. The ink jet device has driving signal supplying means for operating an energy generating element for generating energy utilized to discharge the ink.

What is claimed is:

1. An ink jet recording head comprising:

a discharge port, in communication with an ink path, for discharging ink;

a heating resistor that forms a heating portion for generating thermal energy utilized for discharging the ink from said discharge port;

wiring electrically connected to said heating resistor;

a substrate on which said discharge port, said heating resistor, and said wiring are arranged; and a protective film formed on said heating resistor and said wiring to protect said heating resistor and said wiring, said protective film including:

a first protective film layer, comprised of at least one of a group of materials belonging to a material system, said first protective film layer covering said heating resistor and said wiring;

a second protective film layer, comprised of a material different than the material of said first protective film layer, said second protective film layer covering said first protective film layer except for a portion of said first protective film layer corresponding to the heating portion of said heating resistor, said second protective film layer being comprised of an inorganic material; and a third protective film layer, comprised of a material belonging to the same material system as the material of said first protective film layer, said third protective film layer covering said second protective film layer and said portion of said first protective film layer, and said third protective film being in close contact with said portion of said first protective film.

2. The ink jet recording head of claim 1, wherein said second protective film layer is comprised of a material having a higher etching speed than the material of said first protective film layer.

3. The ink jet recording head of claim 1, wherein said second protective film layer is comprised of a material belonging to the same material system as the material of said first protective film layer.

4. The ink jet recording head of claim 3, wherein said first, second, and third protective film layers each are comprised of a material including silicon.

5. The ink jet recording head of claim 4, wherein said first and third protective film layers each are comprised of silicon nitride, and said second protective film layer is comprised of silicon oxide.

6. The ink jet recording head of claim 5, wherein said second protective film layer is comprised of silicon oxide and includes at least one of boron and phosphorous.

7. The ink jet recording head of claim 1, further comprising a cavitation resisting film formed on said third protective film layer.

8. The ink jet recording head of claim 7, wherein said cavitation resisting film is comprised of tantalum.

9. The ink jet recording head of claim 1, wherein said substrate is comprised of silicon.

10. The ink jet recording head of claim 1, wherein the ink is discharged from said ink jet recording head by utilizing thermal energy generated by the heating portion of said heating resistor to cause the ink to boil.

11. An ink jet recording apparatus comprising the ink jet recording head of claim 1 and a member for mounting said ink jet recording head.

12. The ink jet recording head of claim 1 or 9, wherein said substrate includes a heat accumulating layer on at least a side of said substrate where the heating portion of said heating resistor is disposed.

13. The ink jet recording head of claim 12, wherein the heat accumulating layer is comprised of silicon oxide.

14. A substrate for an ink jet recording head, said substrate having arranged thereon:

a heating resistor that forms a heating portion for generating thermal energy utilized for discharging ink;

wiring electrically connected to said heating resistor; and a protective film formed on said heating resistor and said wiring to protect said heating resistor and said wiring, said protective film including:

a first protective film layer, comprised of at least one of a group of materials belonging to a material system, said first protective film layer covering said heating resistor and said wiring;

a second protective film layer, comprised of a material different than the material of said first protective film layer, said second protective film layer covering said first protective film layer except for a portion of said first protective film layer corresponding to the heating portion of said heating resistor, said second protective film layer being comprised of an inorganic material; and a third protective film layer, comprised of a material belonging to the same material system as the material of said first protective film layer, said third protective film layer covering said second protective film layer and said portion of said first protective film layer, and said third protective film being in close contact with said portion of said first protective film.

15. The substrate of claim 14, wherein said second protective film layer is comprised of a material having a higher etching speed than the material of said first protective film layer.

16. The substrate of claim 14, wherein said second protective film layer is comprised of a material belonging to the same material system as the material of said first protective film layer.

17. The substrate of claim 16, wherein said first, second, and third protective film layers each are comprised of a material including silicon.

18. The substrate of claim 17, wherein said first and third protective film layers each are comprised of silicon nitride, and said second protective film layer is comprised of silicon oxide.

19. The substrate of claim 18, wherein said second protective film layer is comprised of silicon oxide and includes at least one of boron and phosphorous.

20. The substrate of claim 14, wherein a cavitation resisting film is formed on said third protective film layer.

21. The substrate of claim 20, wherein said cavitation resisting film is comprised of tantalum.

22. The substrate of claim 14, wherein said substrate is comprised of silicon.

23. The substrate of claim 14 or 22, wherein said substrate includes a heat accumulating layer on at least a side of said substrate where the heating portion of said heating resistor is disposed.

24. The substrate of claim 23, wherein the heat accumulating layer is comprised of silicon oxide.

25. A method of manufacturing a substrate for an ink jet recording head, the substrate having arranged thereon a heating resistor that forms a heating portion for generating thermal energy utilized for discharging ink, wiring electrically connected to the heating resistor, and a protective film formed on the heating resistor and the wiring to protect the heating resistor and the wiring, said method comprising the steps of:

forming a first protective film layer, comprised of at least one of a group of materials belonging to a material system, so as to cover the heating resistor and the wiring;

forming a film of an inorganic material, different than the material of the first protective film layer, on the first protective film layer;

etching a portion of the film of the inorganic material corresponding to the heating portion of the heating resistor and removing the portion of the inorganic material film to expose a portion of the first protective film layer, thus forming a second protective film layer having an opening where the first protective film layer is exposed; and forming a third protective film layer, comprised of a material belonging to the same material system as the fist protective layer, so as to cover the second protective film layer and the exposed portion of the first protective film layer, wherein the third protective film is in close contact with the exposed portion of the first protective film layer.

26. The method of manufacturing a substrate for an ink jet recording head according to claim 25, wherein the substrate has a heat accumulating layer on which the heating resistor is arranged, the protective film is formed on said heat accumulating layer to protect it, and said first protective film layer covers said heat accumulating layer.

27. An ink jet recording head comprising:

a discharge port, in communication with an ink path, for discharging ink; and a substrate for said ink jet recording head, said substrate including a heat generating resistant member that forms a heat generating portion for generating thermal energy utilized for discharging the ink from said discharge port, wiring electrically connected to said heat generating resistant member, and a protective film provided on said heat generating resistant member and said wiring to protect said heat generating resistant member and said wiring, wherein said protective film includes (i) a first protective film layer covering said heat generating resistant member and said wiring, (ii) a second protective film layer, comprised of an inorganic material having an etching speed greater than that of said first protective film layer, said second protective film layer covering said first protective film layer except for a portion of said first protective film layer corresponding to the heat generating portion of said heat generating resistant member, and (iii) a third protective film layer, comprised of a material similar to that of said first protective film layer, said third protective film layer covering said second protective film layer and said portion of said first protective film layer, and said third protective film being in close contact with said portion of said first protective film.

28. An inkjet recording head according to claim 27, wherein said substrate includes a heat accumulating layer comprising a material having an etching speed similar to that of said second protective film.

29. An ink jet recording head comprising:

a discharge port, in communication with an ink path, for discharging ink; and a substrate for said ink jet recording head, said substrate including a heat generating resistant member that forms a heat generating portion for generating thermal energy utilized for discharging the ink from said discharge port, wiring electrically connected to said heat generating resistant member, and a protective film provided on said heat generating resistant member and said wiring to protect said heat generating resistant member and said wiring, wherein said protective film includes (i) a first protective film layer covering said heat generating resistant member and said wiring, and (ii) a second protective film layer, consisting of an inorganic material having an etching speed greater than that of said first protective film layer, said second protective film layer being formed on said first protective film layer and having an opening therein at a location corresponding to the heat generating portion of said heat generating resistant member.

30. An ink jet recording head according to claim 29, wherein said first protective film layer includes silicon nitride and said second protective film layer includes silicon oxide.

31. A substrate for an ink jet recording head, comprising:

a heat generating resistant member that forms a heat generating portion for generating thermal energy utilized for discharging ink;

wiring electrically connected to said heat generating resistant member; and a protective film provided on said heat generating resistant member and said wiring to protect said heat generating resistant member and said wiring, wherein said protective film includes (i) a first protective film layer covering said heat generating resistant member and said wiring, (ii) a second protective film layer, comprised of an inorganic material having an etching speed greater than that of said first protective film layer, said second protective film layer covering said first protective film layer except for a portion of said first protective film layer corresponding to the heat generating portion of said heat generating resistant member, and (iii) a third protective film layer, comprised of a material similar to that of said first protective film layer, said third protective film layer covering said second protective film layer and said portion of said first protective film layer, and said third protective film being in close contact with said portion of said first protective film.

32. A substrate for an inkjet recording head, comprising:

heat generating resistant member that forms a heat generating portion for generating thermal energy utilized for discharging ink;

wiring electrically connected to said heat generating resistant member; and a protective film provided on said heat generating resistant member and said wiring to protect said heat generating resistant member and said wiring, wherein said protective film includes (i) a first protective film layer covering said heat generating resistant member and said wiring, and (ii) a second protective film layer, comprised of an inorganic material having an etching speed greater than that of said first protective film layer, said second protective film layer being formed on sad first protective film layer and having an opening therein at a location corresponding to the heat generating portion of said heat generating resistant member.

33. An ink jet recording head according to claim 32, wherein said first protective film layer includes silicon nitride and said second protective film layer includes silicon oxide.

34. A method of manufacturing a substrate for an ink jet recording head, the substrate having provided thereon a heat generating resistant member that forms a heat generating portion for generating thermal energy utilized for discharging ink, wiring electrically connected to the heat generating resistant member, and a protective film provided on the heat generating resistant member and the wiring to protect the heat generating resistant member and the wiring thereon, said method comprising the steps of:

forming a first protective film layer so as to cover the heat generating resistant member and the wiring;

forming an inorganic film on the first protective film layer, the inorganic film being comprised of a material having an etching speed greater than that of the first protective film layer; and forming a second protective film layer by etching and removing the inorganic film at a location corresponding to the heat generating portion of the heat generating resistant member to create an opening in the second protective film layer at the location.

35. A method according to claim 34, further comprising a step of forming a third protective film layer so as to cover the second protective film layer and a portion of the first protective film layer that is exposed trough the opening in the second protective film layer, the third protective film layer being comprised of a material similar to that of the first protective film layer, and the third protective film being in close contact with said portion of the first protective film layer.

36. The method of manufacturing a substrate for an ink jet recording head according to claim 34, wherein the substrate includes a heat accumulating layer on which said heat generating resistant member is arranged, said heat generating portion extends lengthwise between the wiring, the protective film is provided on said heat accumulating layer to protect it, said first protective film layer covers said heat accumulating layer, and a width of said portion of said first protective film is greater than a width of said heat generating portion.

37. An ink jet recording head according to claim 27 or 29, wherein said heat generating portion extends lengthwise between the wiring, the substrate includes a heat accumulating layer on which said heat generating resistant member is arranged, the protective film is provided on said heat accumulating layer to protect it, said first protective film layer covers said beat accumulating layer, and a width of said portion of said first protective film is greater than a width of said heat generating portion.

38. The substrate for an ink jet recording head according to claim 31 or 32, further comprising a heat accumulating layer on which the heat generating resistant member is arranged, wherein said heat generating portion extends lengthwise between the wiring, the protective film is provided on said heat accumulating layer to protect it, said first protective film layer covers said heat accumulating layer, and a width of said portion of said first protective layer film is greater than a width of said heat generating portion.

* * * * *

UNITED STATES PATENT AND TRADEMARK OFFICE

CERTIFICATE OF CORRECTION

PATENT NO. : 6,532,027 B2
APPLICATION NO. : 09/210800
DATED : March 11, 2003
INVENTOR(S) : Teruo Ozaki et al.

It is certified that error appears in the above-identified patent and that said Letters Patent is hereby corrected as shown below:

COLUMN 10
Line 3, "fist" should read --first--.

COLUMN 12
Line 21, "trough" should read --through--;
Line 24, "film being" should read --film layer being--; and
Line 43, "beat" should read --heat--.

Signed and Sealed this

Twentieth Day of February, 2007

JON W. DUDAS
*Director of the United States Patent and Trademark Office*